United States Patent [19]

Elliott et al.

[11] 3,963,377

[45] June 15, 1976

[54] PNEUMATICALLY POWERED PUMP SYSTEM

[75] Inventors: J. Kelly Elliott, Baytown; Robert W. Dinning, Houston, both of Tex.

[73] Assignee: Schlumberger Technology Corporation, New York, N.Y.

[22] Filed: May 20, 1974

[21] Appl. No.: 471,277

[52] U.S. Cl. ..... 417/90; 417/71; 417/384; 417/394; 417/395

[51] Int. Cl.[2] ..... F04F 1/18; F04B 9/12; F04B 43/10; F04B 45/00

[58] Field of Search ..... 417/90, 91, 383, 384, 417/394, 395, 115, 109, 386

[56] References Cited

UNITED STATES PATENTS

| | | | |
|---|---|---|---|
| 1,067,613 | 7/1913 | Lane | 417/395 |
| 2,152,802 | 4/1939 | Harris | 417/394 X |
| 2,196,993 | 4/1940 | Kidder | 417/394 UX |
| 2,489,665 | 11/1949 | O'Leary | 417/90 X |
| 2,644,401 | 7/1953 | Ragland | 417/394 X |
| 2,814,993 | 12/1957 | Schmidt | 417/383 |
| 3,215,087 | 11/1965 | McLeod | 417/118 |
| 3,286,640 | 11/1966 | Bauer | 417/385 |
| 3,606,584 | 9/1971 | Sizer | 417/109 |
| 3,814,545 | 6/1974 | Waters | 417/109 X |

*Primary Examiner*—Carlton R. Croyle
*Assistant Examiner*—Richard E. Gluck
*Attorney, Agent, or Firm*—David L. Moseley; William R. Sherman; Stewart F. Moore

[57] ABSTRACT

Disclosed is a pumping system using a pneumatically powered, submerged pump for lifting high viscosity oil from a well. The pump includes a flexible, bag-shaped expansible member or "bladder" mounted within a surrounding housing. Pressurized gas is supplied from the well surface to the bladder through a supply line. An inlet check valve permits oil in the formation to flow into the housing when the bladder is collapsed. When the bladder is expanded or displaced by the gas, the oil in the housing is displaced through an outlet check valve into a flow line which extends to the well surface. A submerged control valve channels gas into the bladder to control the bladder expansion. The control valve also functions to permit the gas in the bladder to flow into a vent tube to control bladder deflation.

In a modified form of the invention, oil flowing into the housing expands the bladder and gas supplied to the housing collapses the bladder. All of the systems may include gas lift valves which communicate gas in the supply line into the flow line to assist in elevating the fluids to the surface.

25 Claims, 9 Drawing Figures

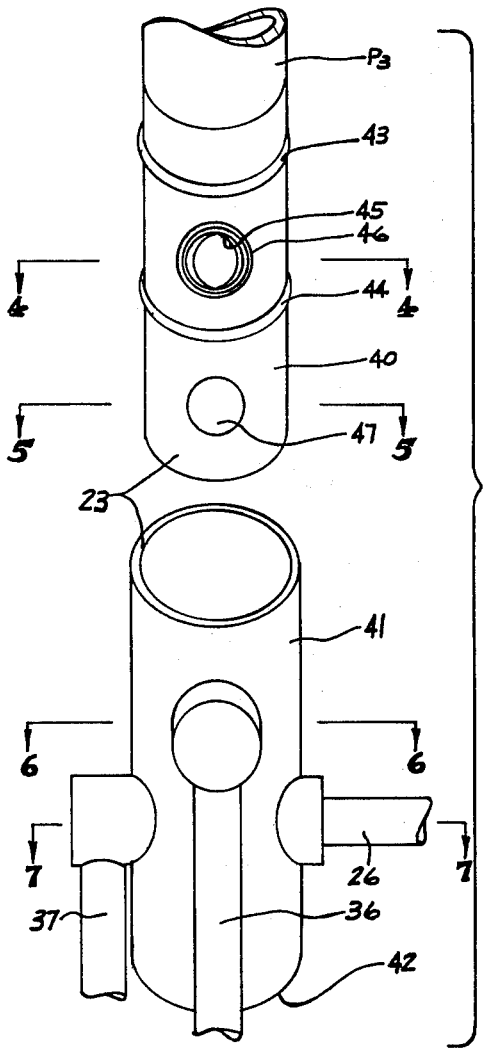
Fig. 3
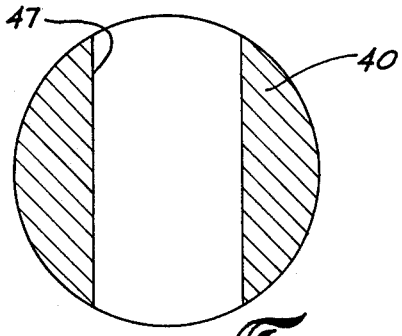
Fig. 5
Fig. 6
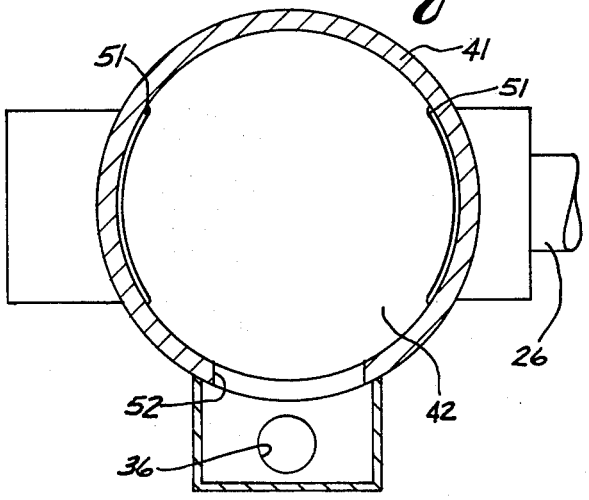
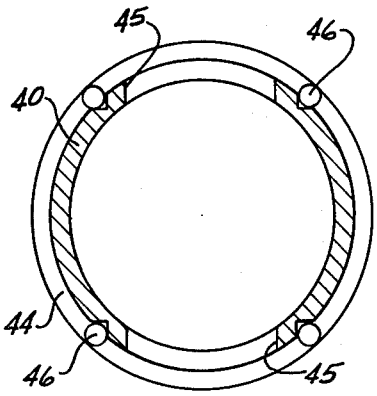
Fig. 4
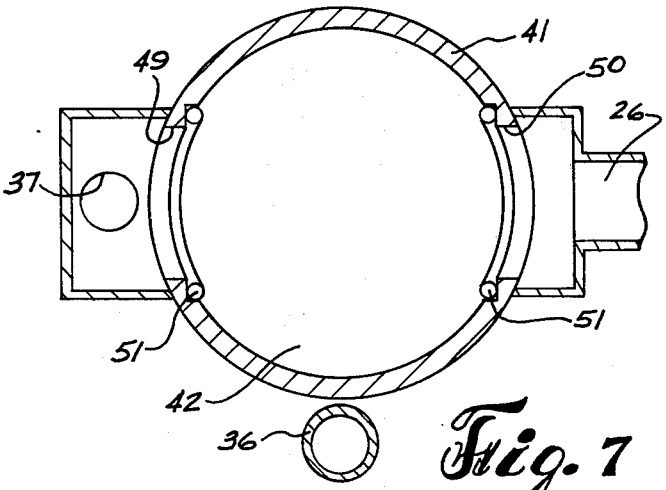
Fig. 7

PNEUMATICALLY POWERED PUMP SYSTEM

BACKGROUND OF THE INVENTION

1. Field of the Invention

The present invention pertains to fluid moving systems for moving fluid from one place to another. In the specific application of the invention to be described hereinafter, the invention relates to a submerged pumping system for elevating high viscosity oil from an underground formation through a well to the well surface.

2. Description of the Prior Art

A variety of types of pumps and artificial lift schemes are in use for producing oil and other liquids from wells where the liquids flow slowly or will no longer flow at all by natural lift. The type of pump selected for use on a particular well is dictated by a number of factors, including the formation pressure and the liquid to be pumped.

Gas lift valves are a well known and efficient means for artificially raising oil to the surface. Submerged mechanical displacement pumps, operated from the surface by reciprocating sucker rods, are also conventionally employed to elevate oil to the well surface, especially where a gas lift installation cannot be used or is not desirable. As compared to gas lift systems, mechanical pumping systems are undesirable to the extent that they entail substantial movement of metal parts which corrode and abrade. Mechanical pumps also produce a relatively limited volume of oil during each pumping cycle and require relatively large amounts of power for their operation. The close tolerances required in most piston-cylinder type mechanical pumps also make such pumps expensive to produce and maintain.

Flexible displacement member or bladder pumps have also been used in various installations for bringing underground oil to the surface. These pumps, which use a distendable diaphragm, bladder or bellows to displace the pumped liquid from a confined area, are particularly useful in wells where the liquid is corrosive or abrasive. Prior art flexible member pumps are usually powered by a mechanically driven piston-cylinder assembly in which the piston acts against a liquid which in turn controls movement of the flexible member. The piston itself is either operated through a mechanical linkage extending from the surface or it is operated by a motor located adjacent the pump. Such systems suffer to a degree from many of the same shortcomings which exist in a conventional mechanical displacement pump. Those systems which require a submerged motor are undesirable in many oil well installations. When used with high viscosity oil, conventional mechanical linkage pumps are inefficient since the density and viscosity of the oil make it difficult to raise the mechanical linkage on the upstroke and prevent the linkage from falling freely during the down stroke.

SUMMARY OF THE INVENTION

In the preferred form of the present invention, a flexible member pump is driven by pressurized gas to elevate oil through a flow line in a well. The flexible member is a bag-like body or bladder contained within a pump housing which in turn is submerged within the subterranean oil to be produced through the well. The bladder is expanded by compressed gas supplied through a supply line which extends from the well surface. The gas acts directly on the flexible member to eliminate the need for an intermediate agent such as a piston. As the bladder is expanded, it displaces oil from the housing causing it to flow through an outlet check valve into the flow line. As the bladder collapses, oil flows from the subterranean formation into the pump housing through an inlet check valve.

The use of a gas drive rather than a hydraulic drive is an important feature of the preferred form of the present invention. Hydraulic drives are undesirable in a long supply line since the hydrostatic pressure of the fluid in the line may prevent the bladder from being collapsed by the low formation pressure existing in some wells. Thus, even though the use of a liquid drive medium would eliminate some of the problems associated with pressurizing a gas, a pump using a liquid drive would be inoperative in low pressure formations which are located a long way below the well surface.

Another important feature of the preferred form of the present invention is the provision of a subsurfce valve in close proximity to the bladder for controlling the supply and release of pressurized gas to and from the bladder. By employing a closely situated valve, the gas supplied to the bladder through the supply line may be maintained at a high pressure at all times so that almost immediately upon the opening of the valve controlling the supply of gas to the bladder, the bladder begins to expand. If the control valve were positioned at a remote location, such as the surface of the well, all of the gas in the supply line between the valve and the bladder would have to be repressured after each collapse of the bladder in order to reinflate the bladder. Where long supply lines are employed, large amounts of energy and time may be required to repressurize the gas in the supply line.

If natural or inert gases are used as the driving fluid, the gas in the expanded bladder may be released directly from the bladder into the annular region between the well casing and the flow line. At the surface, the gas is pressurized and relayed back to the pump. Where air is used as the powering medium, the air is returned from the pump directly to the surface through a separate return line where it may be pressurized and resupplied to the bladder.

An additional feature of the gas driven pump of the present invention is its ability to be used with gas lift valves without need of a separate gas supply line.

The pump system of the present invention may be used to advantage in producing heavy, high viscosity oil which would be difficult to produce with a conventional sucker-rod pump system in which the viscosity and density of the oil severely restrict the movement of the sucker-rod linkage. Use of a flexible bladder rather than a piston eliminates problems associated with corrosion and sand abrasion, and the need for a sliding seal between closely fitting components. Moreover, the pump of the present invention is capable of displacing relatively large volumes of oil during each pumping cycle.

Other features, objects and advantages of the invention will become more readily apparent from the accompanying drawings, specification and claims.

BRIEF DESCRIPTION OF THE DRAWINGS

FIG. 3 is an exploded, perspective view illustrating an exemplary form of a subsurface control valve used to control the flow of gas into and out of the pump housing of the present invention;

FIG. 4 is an enlarged scale, horizontal cross-section taken along the line 4—4 of FIG. 3;

FIG. 5 is an enlarged scale, horizontal cross-section taken along the line 5—5 of FIG. 3;

FIG. 6 is an enlarged scale, horizontal cross-section taken along the line 6—6 of FIG. 3;

FIG. 7 is an enlarged scale, horizontal cross-section taken along the line 7—7 of FIG. 3;

DESCRIPTION OF THE ILLUSTRATED EMBODIMENTS

Figure 1:
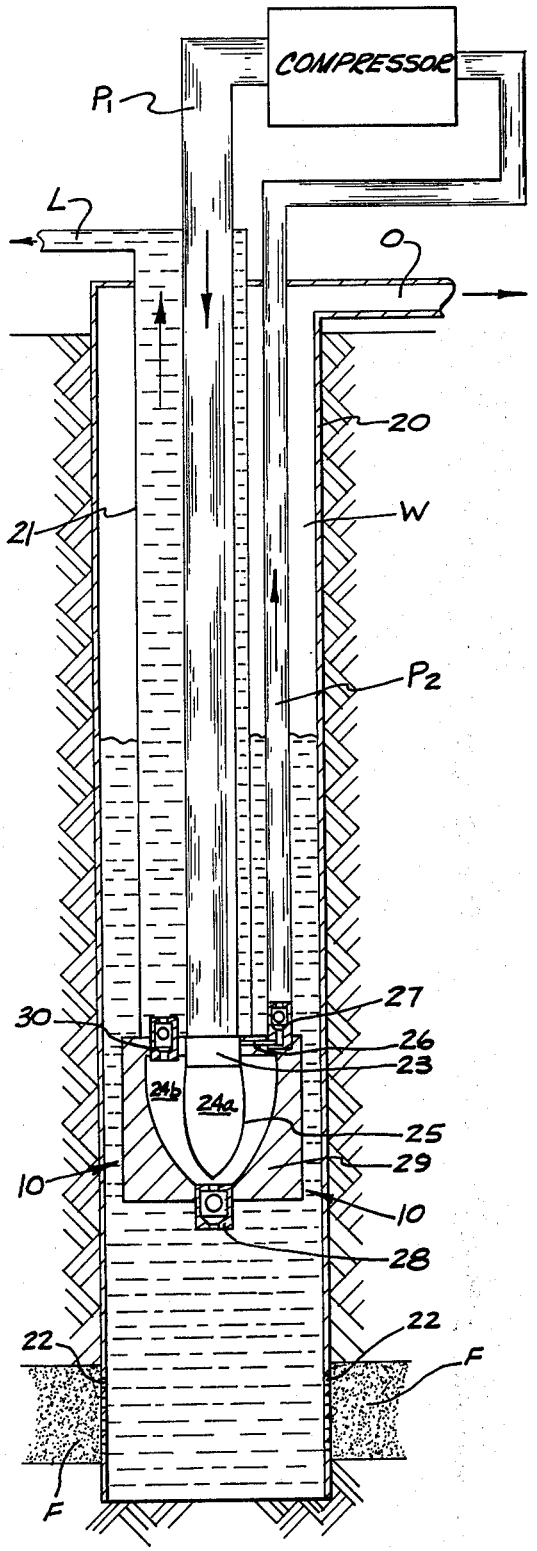
FIG. 1 is a partial vertical section schematically illustrating one form of the system of the invention in which a driving gas is delivered back to the surface through a separate return line.

FIG. 1 schematically illustrates the flexible member pump system of the present invention. The pump portion of the system is indicated generally at 10, submerged in a well W which extends between the earth's surface and a submerged oil formation F. The pump 10 is retrievably suspended within a well casing 20 by a standard pipe string 21. The pipe string 21 also serves as the flow line for conducting oil to the well surface. At the surface, the oil flows through a production line L to a remote storage or processing facility (not illustrated). Perforations 22 extend through the well casing 20 and permit the oil in the formation to enter the casing. Gas entering the well casing 20 from the formation F rises to the surface in the well casing where it is carried off by a conduit 0.

A supply line P1, contained within the pipe string 21, supplies a pressurized driving gas, such as natural gas or air, to the pump 10 for powering the pump. Gas is provided by a compressor at the surface. A second pipe string P2, used when air is the driving gas, returns expelled gas from the pump 10 to the surface where it is repressurized by the compressor. As used herein, the term "fluid" is used with reference to the matter being pumped or displaced. The matter being pumped may, however, include gasses, and/or liquids, and/or any other materials which are capable of being carried in a fluid stream and is not limited to materials falling within the strict technical meaning of the term fluid. By way of example rather than limitation, slurries of coal and water would be capable of being pumped, moved or displaced by the present invention. Accordingly, while specific reference is made in the specification and claims hereof to fluids or "fluid to be moved" or "displaced fluid", these terms are used for ease of description only and are intended to include any matter which is capable of being displaced, pumped or otherwise moved.

A subsurface control valve 23 controls the input of gas from the line P1 into a pump chamber **24*a* contained within a flexible bag-like member or bladder 25 in the pump 10. The chamber 24*a*, forming the interior of the flexible bladder 25, serves as an expansion chamber which increases in volume when exposed to the pressurized gas supplied by the line P1. The valve 23 also controls the flow of gas from the area 24*a* through a passage 26 to a check valve 27 which permits the gas to exhaust to the line P2. The bladder 25 is returned to its original position under the influence of the formation pressure. This return movement of the bladder is independent of the pressure of the gas in the line P1. At the base of the pump 10, a check valve 28 permits formation oil to enter a chamber 24*b* in the pump housing 29. The chamber 24*b* functions as a holding chamber for temporarily holding the fluid to be moved. The bladder 25 functions as a displacement means which is responsive to the application of pressure of the fluid drive medium in the expansion chamber 24*a* to displace the fluid to be moved from the holding chamber 24*b*. A second check valve 30 at the top of the pump 10 permits oil to be displaced from the pump into the pipe string flow line 21** for conduction to the surface.

While the displacement means is specifically illustrated as a bladder, it will be appreciated that other suitable displacement means may be used where such means are capable of displacing fluid from one place to another under the driving influence of the pressurized gas supplied by the line P1.

Figure 2:
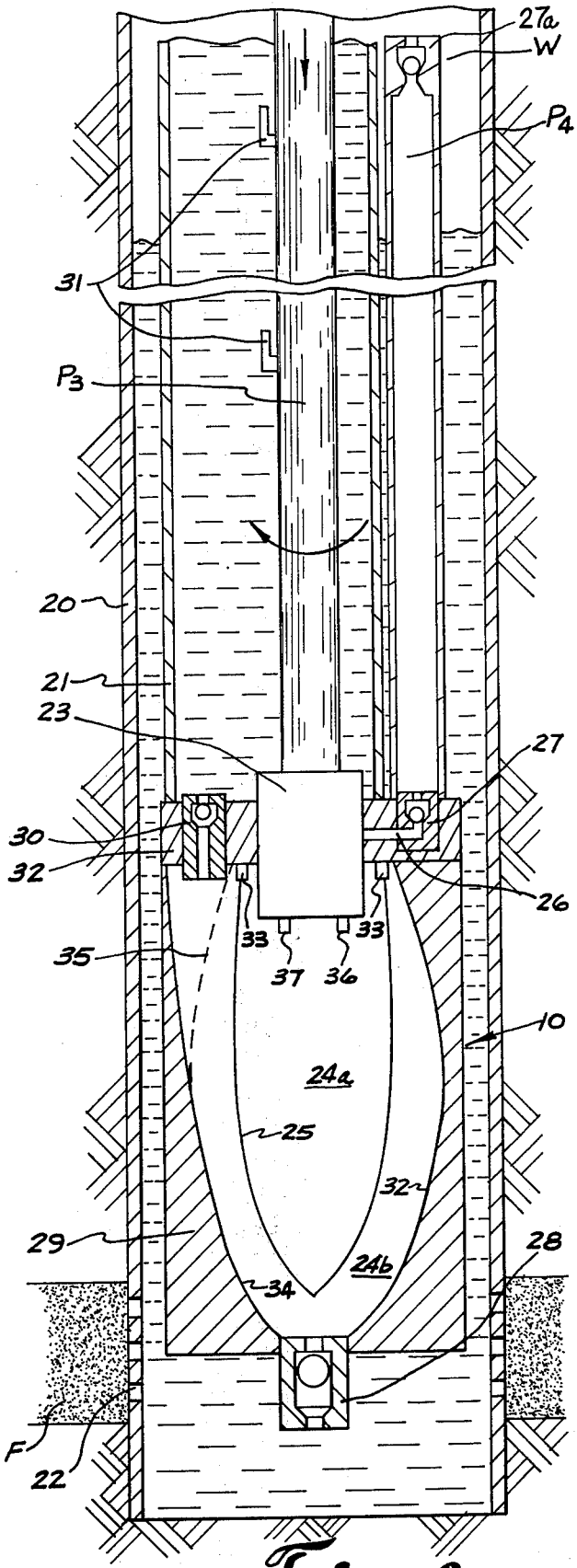
FIG. 2 is a partial vertical section of a well illustrating details in the flexible member pumping system of the present invention and also illustrating the use of gas lift valves as a part of the system.

A modified form of the system of the present invention is illustrated in FIG. 2. The pump portion 10 of both FIGS. 1 and 2 are identical and components identically numbered function similarly. FIG. 2 provides details in the construction of the pump portion 10 and illustrates the pump employed with gas lift valves 31 for use when natural gas or inert gas is used as the driving gas. A supply line P3 is employed to conduct the gas to the pump 10 and the exhaust gas from the pump is vented, through a pipe line P4, directly into the well W at a point above the surface of the oil in the well casing 20. The operating efficiency of the bladder pump is greatest when the driving gas is released at the lowest possible pressure. Therefore, the pipe P4 is employed to carry the expelled driving gas from the pump to a height above the surface of this emerging oil. The driving gas then mixes with gas from the oil formation, and is carried off at the surface. A check valve **27*a* prevents overflow from entering the pipe P4**.

The bladder 25 is suspended within the housing 29 from a top assembly 32 which forms the upper part of the pump housing 29. The bladder is firmly anchored to the top assembly 32 by any suitable locking device 33 which cooperates with the assembly 32 and the bladder 25 to seal the two inner chambers **24*a* and 24*b*** from each other.

The internal surface 34 of the housing 29 has the same general size and shape as that of the expanded bladder. The surface 34 thus functions as a guard surface to envelop the bladder to prevent it from over extending and being destroyed. The upper portion of the guard surface 34 in the vicinity of the outlet valve 30 is in the form of a screen 35 to allow oil in the chamber **24*b* to reach the valve 30** when the bladder is expanded.

The control valve 23, mounted in the top assembly 32, selectively permits the gas in the line P3 to flow into the chamber **24*a* or selectively terminates this input flow and provides a path for the release of gas from the chamber 24*a* into the pipe line P4. The released gas is channeled to the pipe line P4 through the passage 26 and the check valve 27. The control valve 23** is operated by rotation of the line P3 as will hereinafter be more fully explained.

In operation, pressurized natural or inert gas supplied from some surface source is conveyed to the pump 10 through the supply line P3. The line P3 is rotated to cause the valve 23 to supply the gas in the line to the chamber 24*a* through an input line 36 which causes the bladder 25 to expand outwardly against the surrounding guard surface 34. Expansion or displacement of the bladder 25 displaces the oil from the chamber 24*b* causing it to flow through the valve 30 into the flow line 21. Following expansion of the bladder, the line P3, is rotated to a position in which the control valve 23 terminates the flow of gas from the line P3 to the chamber 24*a* and communicates the chamber 24*a* with the pipe line P4 through a passage formed by lines 37 and 26. As the gas from the bladder chamber 24*a* vented through the pipe line P4, the bladder 25 collapses and oil flows into the chamber 24*b* through the check valve 28. Thereafter, the line P3 is rotated to a position in which the valve 23 operates to resupply gas to the bladder 25 and to close the passage between the bladder and the pipe line P4. The bladder 25 is expanded by the gas and the previously described cycle is repeated.

If desired, the line P3 may be equipped with conventional gas lift valves 31. Such valves function automatically, for example, to open only when they are below the oil level in the flow line 21 and only when the hydrostatic pressure of the oil acting on the valve exceeds some predetermined value. Any other conventional gas lift installation may be employed in combination with the pump 10 whereby the pressurized gas in the line P3 functions to displace oil from the pump housing 29 into the flow line 21 and also functions to operate gas lift valves which inject gas into the oil in the flow line 21. While gas lift valves 31 are illustrated only in FIG. 2, it will be appreciated that such valves may be employed in any of the modifications of the invention described herein.

An exemplary embodiment of the control valve 23 is illustrated in detail in FIGS. 3–7 of the drawings. The valve 23 includes a cylindrical valve stem 40 which is rigidly fixed on the end of, and rotates with, the supply line P3. The stem 40 is adapted to be received within a tubular housing 41 which is rigidly fixed to the pump top assembly 32. The housing 41 has a flat bottom surface 42 and is open at its top.

The stem 40 is divided into three portions by two annular seals 43 and 44. The upper two portions of the stem 40, which are hollow, communicate with the interior of the pipe stiring P3. Two similar windows 45 are located in the wall of the stem 40 diametrically opposite each other, between the two seals 43 and 44. Seals 46 carried in appropriate grooves on the outer surface of the stem 40 encircle the windows 45. The portion of the stem 40 below the lower annular seal 44 is solid except for a diametrically formed bore 47 which is aligned so that its axis is parallel to a straight line passing through, and aligning, the center of both windows 45.

When the valve 23 is assembled, the stem 40 fits with close tolerance in the housing 41 with the stem bottom resting on the interior bottom of the housing. Two windows, 49 and 50, located on opposite sides of the housing 41, communicate with the bore 47 in the stem 40 when the two components are assembled and properly aligned. The window 49 provides an opening through the connecting line 37 to the interior of the pump housing 29 while the window 50 provides an opening to the connecting line 26 which in turn communicates through the valve 27 with the pipe line P4 when the stem and housing are properly aligned. O-ring seals 51, carried in appropriate grooves in the interior surface of the valve housing 41, encircle the two windows 49 and 50.

A third window 52 in the housing 41, disposed at 90° relative to the diameter connecting the windows 49 and 50, communicates with the windows 45 in the upper portion of the stem 40 when the stem and housing 41 are assembled and properly aligned. The housing window 52 communicates through the connecting line 36 to the interior of the pump housing 29. Thus, when the stem 40 is properly rotated within the housing 41, the pipe string P3 may convey compressed gas to the upper portion of the valve stem 40, through one of the stem windows 45, through the upper housing window 52, through the connecting line 36 and into the housing chamber 24*a*. When the bore 47 communicates with the lower housing windows 49 and 50, the stem windows 45 are sealed off from the upper housing window 52; when one or the other of the stem windows 45 communicates with the upper housing window 52, the bore 47 is sealed off from both of the lower housing windows 49 and 50 and the windows 49 and 50 are also sealed off from each other. The dimensions of the windows and bores in the valve 23 are preferably such that the line P3 may be rotated in a single direction at a rate which causes the collapsed bladder 25 to begin to expand as soon as the chamber 24*b* is full and which causes the expanded bladder to vent the gas as soon as substantially all of the oil in the chamber 24*b* is displaced into the flow line 21. From the foregoing, it will be appreciated that as the valve stem 40 is made to rotate by the rotating pipe string P3, the bladder chamber 24*a* is alternately connected to the supply of compressed gas from the line P3, sealed away from the compressed gas supply and then connected to the pipe line P4. This causes the bladder to alternately expand and collapse as required to pump oil to the well surface.

Figure 8:
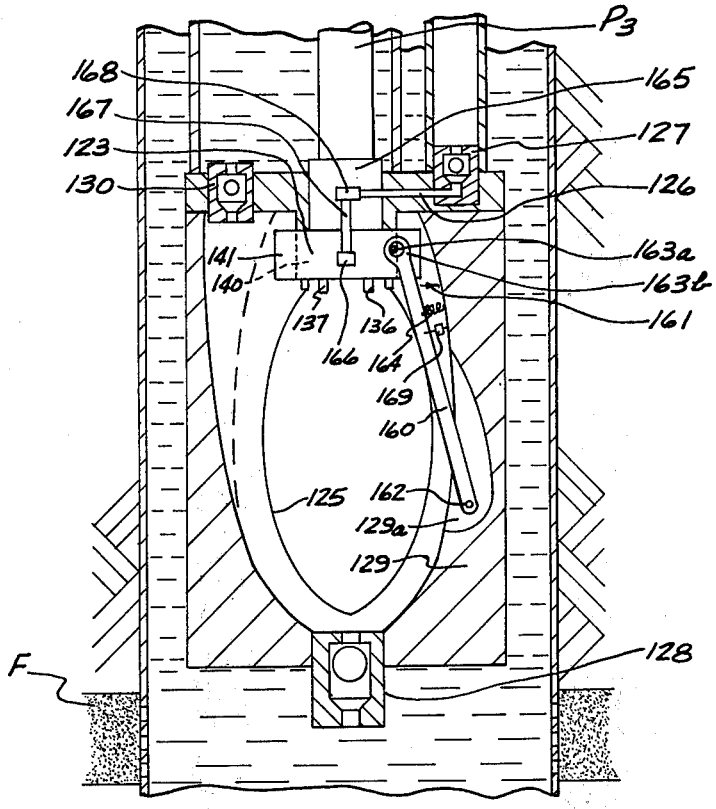
FIG. 8 is a partial vertical section schematically illustrating an automatic control valve for use with the pump of the present invention.

The valve 23 is intended to be exemplary and any suitable valve capable of repeatedly connecting the pressurized gas supply in the line P3 to the bladder 25 and then disconnecting the supply and connecting the bladder chamber 24*a* with an outlet passage which permits the bladder to deflate would be satisfactory. It will be appreciated that a self-contained valve, operated by the expansion and collapse of the bladder rather than by rotation of the line P3, may be employed. The valve 123 illustrated schematically in FIG. 8 is exemplary of a simple mechanism having these capabilities. The valve 123 includes a housing 141 and a stem 140, similar to the housing 41 and stem 40 of the valve 23. The stem 140 is, however, stationary and the housing 141 is mounted on the stem 140 for limited rotational movement thereabout. As the bladder 125 expands, it forces a mechanical actuator arm 160 to pivot in the direction of the arrow 161 about a pin mounting 162 set in an appropriate recess 129*a* in the housing 129. The actuator 160 is connected to the valve housing 141 by a suitable pin 163*a* and ring 163*b* connection. The pin 163*a* is secured to the housing 141 and causes the housing 141 to rotate about the stem 140 as the actuator arm 160 moves. The lost motion between the ring 163*b* and pin 163*a* prevents the valve 123 from fluctuating back and forth between an opened and closed position. During the expansion portion of the cycle, a spring 164 is compressed. During the collapse portion of the cycle, the spring 164 pivots the actuator 160 in a direction opposite to that indicated by the arrow 161. The bores and windows of the valve 123 correspond to those of the valve 23 of FIGS. 1 and 2 and are dimensioned and positioned so that the gas in the bladder 125 is vented after the bladder is expanded beyond a given amount and gas is resupplied to the bladder 125 after the bladder is deflated more than a given amount. The components 126, 127, 128, 130, 136 and 137 perform the same functions as the components 26, 27, 28, 30, 36 and 37, respectively, of the valve 23. The fitting 165 is stationary and connects with the stem 140 to provide pressurized gas to the pump of FIG. 8.

The outlet line 137 runs within the valve housing 141 to a connector 166 extending to the exterior of the housing above the bladder 125. A flexible vent line 167 joins the connector 166 with a similar connector 168 located on the stationary fitting 165. From there, the gas expelled from the bladder passes along line 126 to the outlet valve 127. Thus, the flexible vent line 167 maintains continuity between the oscillating valve housing 141 and the fixed outlet valve 127 throughout the oscillation of the housing. It will be appreciated that the representation shown here is schematic only and any other suitable means may be used to convey the exhaust gas into the pipe line or into a return conduit.

A snap device 169 snaps the actuator 160 in the direction it is moving after the actuator moves beyond a predetermined distance in either direction. The device 169, which may be any suitable means capable of providing the necessary snap action, moves the valve 123 to prevent the pump from being stymied which would occur, for example, where the valve is beginning to communicate pressurized gas into the bladder 125 while the bladder exhaust vent is still partially open. Under these conditions, the gas would be vented without expanding the bladder and the pump would be stymied.

While two exemplary control valves have been described, others could be employed. For example, a control valve operated by an actuator with a self-contained power supply may be used. Such a valve could be controlled by a clock or by an electrical control actuated by switches which open or close in response to bladder movement or position. A remotely transmitted signal could also act as the control.

Figure 9:
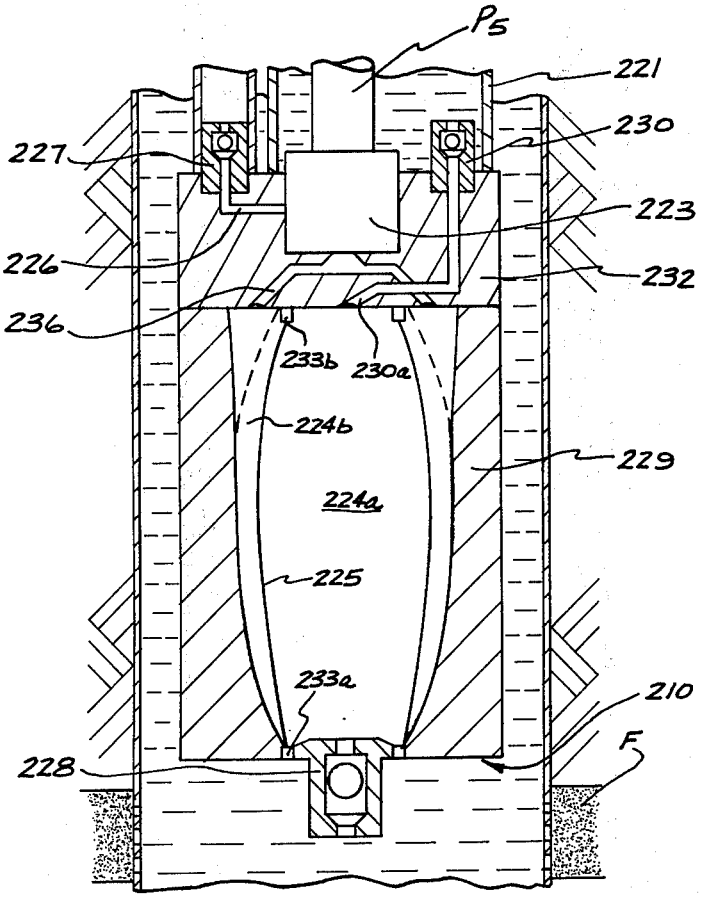
FIG. 9 is a partial vertical section of a well schematically illustrating a modified form of the pump of the present invention.

FIG. 9 shows another embodiment of a flexible member pump, indicated generally at 210. A flexible member or bladder 225 divides the interior of a rigid pump housing 229 into two chambers **224*a* and 224*b*. The bladder 225 is in the form of a bag open at both ends. The lower end of the bladder is anchored and sealed to the housing 229 by a suitable seal device 233*a* so as to encircle an inlet check valve 228. The top end of the bladder 225 is similarly anchored and sealed by a suitable seal device 233*b* so as to encircle the mouth of a passage 230*a* leading to an output check valve 230. The valve 230 and the passage 230*a* are located in a top assembly 232 of the pump housing 229. Oil flows into the housing 229 through the input valve 228 then exits the housing and enters a flow line 221 through the passage 230*a* and the output valve 230. While inside the pump housing 229, the oil is contained within the bladder chamber 224*a*. The chamber 224*b* is alternately exposed to pressurized gas supplied to the pump 210 by a pipe line P5. A control valve, shown generally at 223, similar to the valve 23, controls the flow of gas from the line P5 through passages 236 to the chamber 224*b*, or from the chamber 224b through passage 226 to the gas outlet valve 227. Like the valve 23, valve 223 is also a rotating valve, operated by the pipe string P5, which is rotated by an appropriate driving device (not shown) at the well surface. Other features of the pump 210 are similar to those of the pump 10.**

The flexible members or bladders described herein may be constructed of natural or synthetic rubber or other leak-proof, non-corrosive flexible materials which are capable of being repeatedly expanded and collapsed, or other suitable materials. If desired, the internal surfaces of the housing may be coated with a protective material such as plastic or other suitable means. In some applications, the housing may desirably be constructed of plastic materials rather than metal.

The foregoing disclosure and description of the invention is illustrative and explanatory thereof, and various chages in the size, shape and materials as well as in the details of the illustrated construction may be made within the scope of the appended claims without departing from the spirit of the invention.

We claim:

1. A system for moving fluid from a first place to a second place comprising:

a. a pump housing means at said first place;

b. gas pressure supply means for providing a pressurized gas;

c. supply conduit means connecting said housing means and said gas supply means for supplying pressurized gas to said housing means;

d. holding chamber means within said housing means for receiving and temporarily holding said fluid;

e. one-way inlet flow conduit means for ingress of said fluid into said holding chamber means;

f. one-way outlet flow conduit means for egress of said fluid out of said holding chamber means;

g. expansion chamber means within said housing means for receiving pressurized gas from said supply conduit means;

h. displacing means including a flexible bladder within said housing means disposed between said holding chamber means and said expansion chamber means and dividing the interior of said housing means into said holding chamber means and said expansion chamber means, said displacing means being responsive to force from said pressurized gas in said expansion chamber means to increase the volume of said expansion chamber means and decrease the volume of said holding chamber means thereby causing said fluid to flow from said holding chamber means through said outlet flow conduit means, said displacing means further being selectively responsive to force from said fluid in said holding chamber means to increase the volume of said holding chamber means and decrease the volume of said expansion chamber means thereby causing gas to flow from said expansion chamber means;

i. flow line means connecting said outlet flow conduit means and said second place for conducting said fluid, displaced from said holding chamber means, from said first place to said second place; and j. subsurface control means comprising inlet control means for ingress of said pressurized gas from said supply conduit means into said expansion chamber means and outlet control means for egress of said gas out of said expansion chamber means, said control means selectively operable to permit said pressurized gas to enter said expansion chamber means through said inlet control means while preventing said gas in said expansion chamber means from leaving said expansion chamber means thereby forcing said fluid out of said holding chamber means through said outlet flow conduit means, said control means further being selectively operable to prevent said pressurized gas from entering said expansion chamber means from said supply conduit means while permitting said gas in said expansion chamber means to be forced out of said expansion chamber means through said outlet control means in response to movement of said displacing means caused by the pressure exerted by the fluid in said holding chamber means.

2. A system for moving fluids as defined in claim 1 wherein said control means is in close proximity to said expansion chamber means whereby a relatively small volume of said pressurized gas is included between said expansion chamber means and said control means.

3. A system for moving fluids as defined in claim 1 further including means for repressurizing said gas flowing outwardly from said expansion chamber means through said outlet control means and for supplying said repressurized gas to said supply conduit means.

4. A system for moving fluids as defined in claim 1 wherein said second place is higher than said first place.

5. A system for moving fluids as defined in claim 1 wherein:

a. said first place is a subsurface point within a well;
b. said second place is the surface of said well; and
c. said fluid includes oil.

6. A system for moving fluids as defined in claim 1 further including retaining means within said housing means for limiting the movement of said flexible member.

7. A system for moving fluids as defined in claim 6 wherein said control means is in close proximity to said expansion chamber means whereby a relatively small volume of said pressurized gas is included between said expansion chamber means and said control means.

8. A system for moving fluids as defined in claim 4 further including gas outlet conduit means isolated from said flow line means for conducting said gas from said expansion chamber means to said second place.

9. A system for moving fluids as defined in claim 8 wherein said control means is in close proximity to said expansion chamber means whereby a relatively small volume of said pressurized gas is included between said expansion chamber means and said control means.

10. A system for moving fluids as defined in claim 9 further including gas lift valve means connected with said supply conduit means for injecting gas from said supply conduit means into said fluid in said flow line means for reducing the density of said fluid in said flow line means.

11. A system for moving fluids as defined in claim 7 wherein said flexible bladder is expanded by said pressurized gas to move fluid from said holding chamber means.

12. A system for moving fluids as defined in claim 11 wherein said second place is higher than said first place.

13. A system for moving fluids as defined in claim 12 further including gas lift valve means connected with said supply conduit means for injecting gas from said supply conduit means into said fluid in said flow line means for reducing the density of said fluid in said flow line means.

14. A system for moving fluids as defined in claim 12 further including gas outlet conduit means isolated from said flow line means for conducting said gas from said expansion chamber means to said second place.

15. A system for moving fluids as defined in claim 1 further including automatic means connected with said control means for automatically operating said control means to permit said expansion chamber means to cyclically expand and contract.

16. A system for moving fluids as defined in claim 7 wherein said flexible bladder is collapsed by said pressurized gas to move fluid from said holding chamber means.

17. A system for moving fluids as defined in claim 1 wherein said control means is operable by rotation of said supply conduit means to case said pressurized gas to be selectively supplied to said expansion chamber means for cyclically expanding and contracting said expansion chamber means.

18. A system for elevating subsurface oil from a subsurface formation which communicates with a well bore comprising:

a. a pump housing means adapted to be placed in said well bore and submerged in said subsurface oil;
b. supply conduit means connected between said housing means and the well surface for supplying a pressurized gas to said housing means;
c. expansion chamber means provided within said housing means for receiving said pressurized gas from said supply conduit means;
d. holding chamber means included in said housing means for receiving and temporarily holding the oil to be elevated;
e. displacing means comprising a flexible bladder disposed between said expansion chamber means and said holding chamber means for forming a pressure seal therebetween, said displacing means being movable in response to the existence of a fluid-induced pressure differential between said expansion chamber means and said holding chamber means for displacing oil from said holding chamber means when the pressure in said expansion chamber means is greater than that in said holding chamber means and for permitting subsurface oil to enter said holding chamber means when the pressure in said expansion chamber means is lower than that in said holding chamber means;
f. flow line means extending from said holding chamber means to the well surface for conducting oil displaced from said holding chamber means to the well surface;
g. subsurface control means included in said system for regulating the flow of said pressurized gas into and out of said expansion chamber means;
h. first check valve means connected with said holding chamber means for permitting the one-way flow of oil from said holding chamber means into said flow line means; and
i. second check valve means connected with said holding chamber means for permitting the one-way flow of subsurface oil into said holding chamber means.

19. A system as defined in claim 18 wherein said control means is adjacent said housing means.

20. A system as defined in claim 19 wherein said displacing means is a flexible bladder which expands when said pressurized gas is supplied to said expansion chamber means.

21. A system as defined in claim 18 further including gas lift valve means connected with said supply conduit means for injecting gas from said supply conduit means into oil in said flow line means.

22. A system as defined in claim 21 further including means for controlling the injection of gas from said gas lift valve means into said flow line means such that gas is injected when said holding chamber means is receiving subsurface oil and injection of gas is terminated when said displacing means is displacing oil from said holding chamber means.

23. A system as defined in claim 18 wherein said control means includes a self-contained valving means automatically operable as a function of the position of said displacing means for permitting said gas to flow into or our of said expansion chamber means as said holding chamber means respectively empties and fills.

24. A system as defined in claim 18 wherein said bladder expands when said pressurized gas is supplied to said expansion chamber means.

25. A system as defined in claim 18 wherein said bladder collapses when said pressurized gas is supplied to said expansion chamber means.

* * * * *